US006644513B1

(12) United States Patent
Nesbitt

(10) Patent No.: US 6,644,513 B1
(45) Date of Patent: Nov. 11, 2003

(54) SELF DEFENSE PENDANT

(76) Inventor: Stephanie A. Nesbitt, 101 Lochwood East. Dr., Cary, NC (US) 27511

( * ) Notice: Subject to any disclaimer, the term of this patent is extended or adjusted under 35 U.S.C. 154(b) by 0 days.

(21) Appl. No.: 10/230,798

(22) Filed: Aug. 29, 2002

(51) Int. Cl.[7] ..... B65D 83/14

(52) U.S. Cl. ..... 222/175; 222/192; 63/1.14; 63/29.1

(58) Field of Search ..... 222/175, 183, 222/192, 131; 63/1.11, 1.14, 1.15, DIG. 2, 29.1

(56) References Cited

U.S. PATENT DOCUMENTS 3,124,286 A * 3/1964 Dompier ..... 224/255
4,023,712 A * 5/1977 Babiak et al. ..... 222/175
4,245,486 A * 1/1981 Matsumoto et al. ..... 63/23
5,088,624 A * 2/1992 Hackett et al. ..... 222/78
5,261,570 A * 11/1993 Hippely et al. ..... 222/212
5,310,086 A * 5/1994 Julinot ..... 222/1
5,992,715 A * 11/1999 Habibi ..... 224/247

* cited by examiner

*Primary Examiner*—Kevin Shaver
*Assistant Examiner*—Stephanie Willatt

(57) ABSTRACT

A self defense pendant and necklace with a pendant assembly including: a removable and replaceable front panel, a main body capable of retaining a small pressurized spray canister and associated spray head, and a hinged top portion that allows access to the top of the spray head. The pendant front includes a horizontally disposed orifice at its top potion that allows pepper spray to exit the front of the pendant assembly. The main body includes an orifice at its top most portion to allow a necklace to be attached to the pendant assembly. The pendant front includes a decorative element. A necklace assembly includes a necklace and attached lanyard. The lanyard is retained in a coiled manner inside a standard spring reel assembly so that the necklace can be extended outward when the user wants to access the pepper spray function and automatically return to its original position after use as a defensive implement.

1 Claim, 5 Drawing Sheets

SELF DEFENSE PENDANT

BACKGROUND OF THE INVENTION

This invention relates generally to the field of self defense devices, and more particularly to a self defense pendant.

For thousands of years, women have had to, from time to time, protect themselves from an assault by a potential attacker.

To this end, a number of portable defensive devices have been developed from small concealed knives to small guns and other weapons. In recent times, the use of pepper spray has been promoted as a means of temporarily disabling an attacker. This is accomplished when the pepper spray makes contact with the attacker's eyes thereby temporarily blinding him or her.

Although the use of pepper spray has proven effective in the warding off of an attacker, the user often wastes valuable time in the process of locating the pepper spray cannister which may be buried in the user's purse or other hard to reach locations. There is therefore, a need for a pepper spray device that is readily available in case of an attack. The quick availability of the pepper spray device may mean the difference between effective deterrence and bodily harm.

SUMMARY OF THE INVENTION

The primary object of the invention is to provide a self defense pendant that allows the user quick access to a pepper spray device to ward off a potential attacker.

Another object of the invention is to provide a self defense pendant that can be quickly extended out to a useful distance without breaking the necklace that holds the pendant around the user's neck.

Another object of the invention is to provide a self defense pendant where the front decorative portion of the pendant can be removed and replaced, both to replace the enclosed pressurized pepper spray container and to allow the user to choose between a plurality of decorative front panels.

A further object of the invention is to provide a self defense pendant where the user can quickly open a hinged lid to gain access to a push button spray head.

Other objects and advantages of the present invention will become apparent from the following descriptions, taken in connection with the accompanying drawings, wherein, by way of illustration and example, an embodiment of the present invention is disclosed.

Self Defense Pendant and necklace comprising: a pendant assembly comprising a removable and replaceable front panel, a main body capable of retaining a small pressurized spray cannister and associated spray head and a hinged top portion that allows access to the top of said spray head, said pendant front including a horizontally disposed orifice at its top portion that allows pepper spray to exit the front of said pendant assembly, said main body including an orifice at its top most portion to allow a necklace to be attached to said pendant assembly, said pendant front including a decorative element, and a necklace assembly that includes a necklace and attached lanyard, said lanyard retained in a coiled manner inside a standard spring reel assembly so that said necklace can be extended outward when the user wants to access the pepper spray function and automatically return to its original position after use as a defensive implement.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
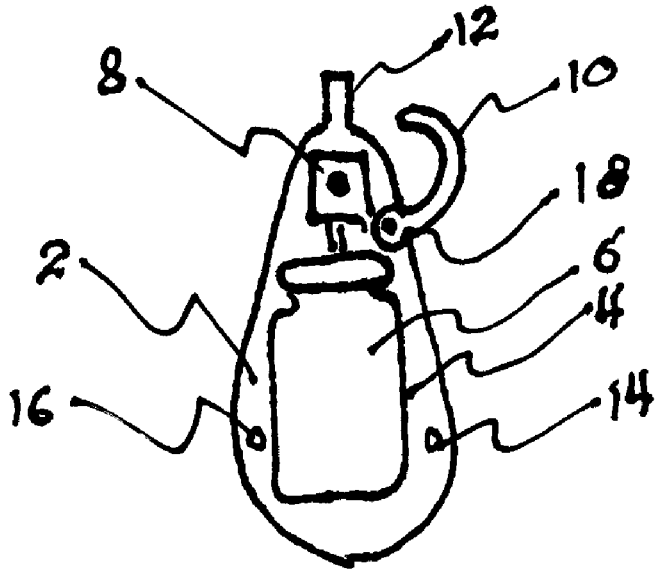
FIG. 1 is a front view of the main body of the pendant assembly of the present invention.
Figure 2:
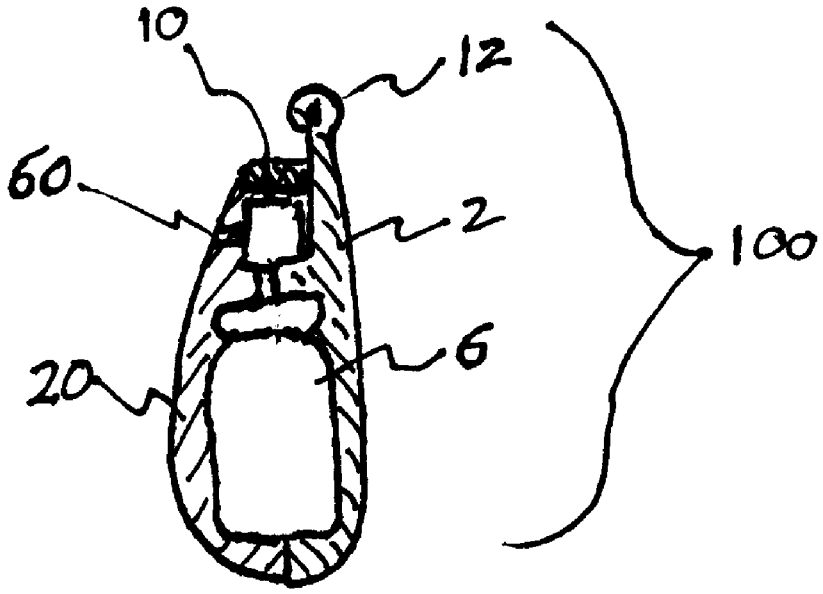
FIG. 2 is a side view of the pendant assembly of the present invention.
Figure 3:
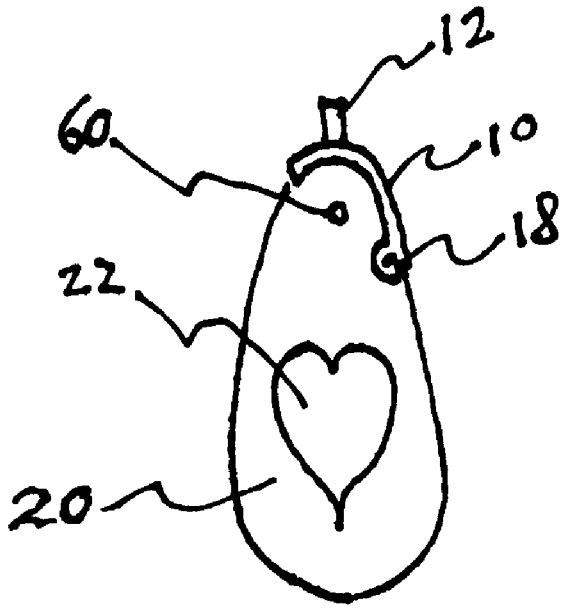
FIG. 3 is a front view of the front cover of the pendant assembly of the present invention.
Figure 4:
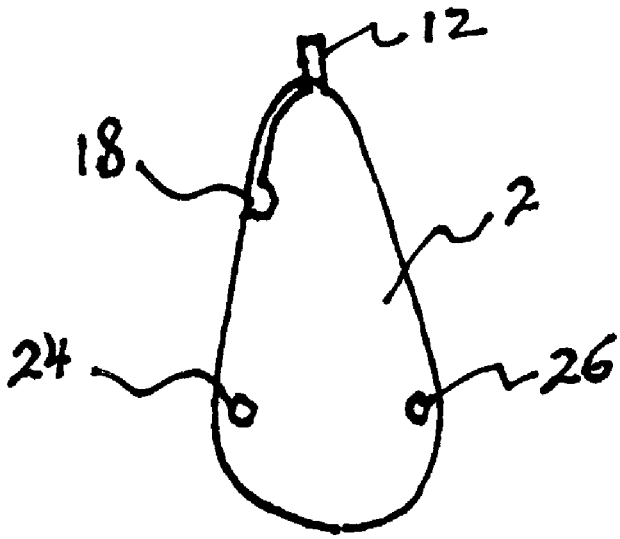
FIG. 4 is a rear view of the main body of the pendant assembly of the present invention.
Figure 5:
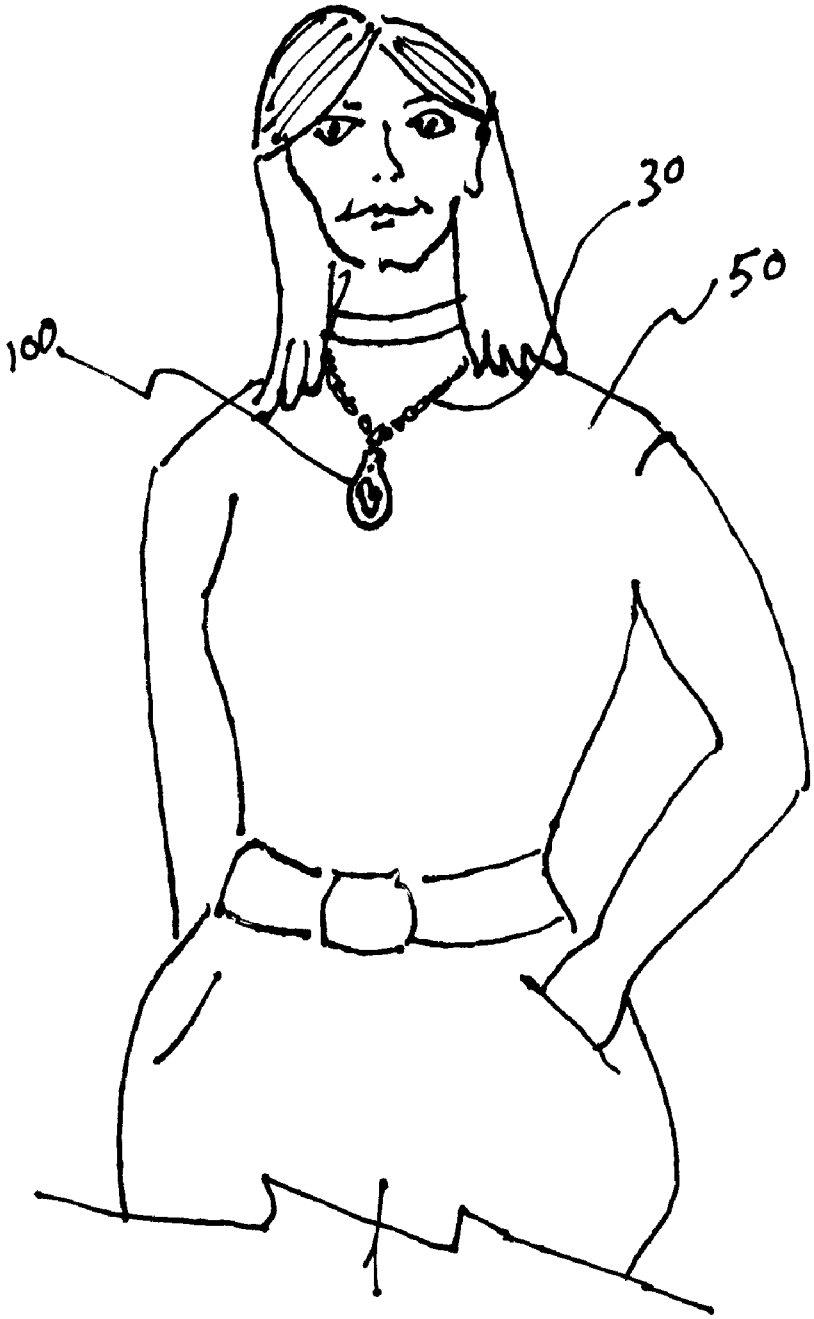
FIG. 5 is a perspective view of a person wearing the pendant and necklace of the present invention.
Figure 6:
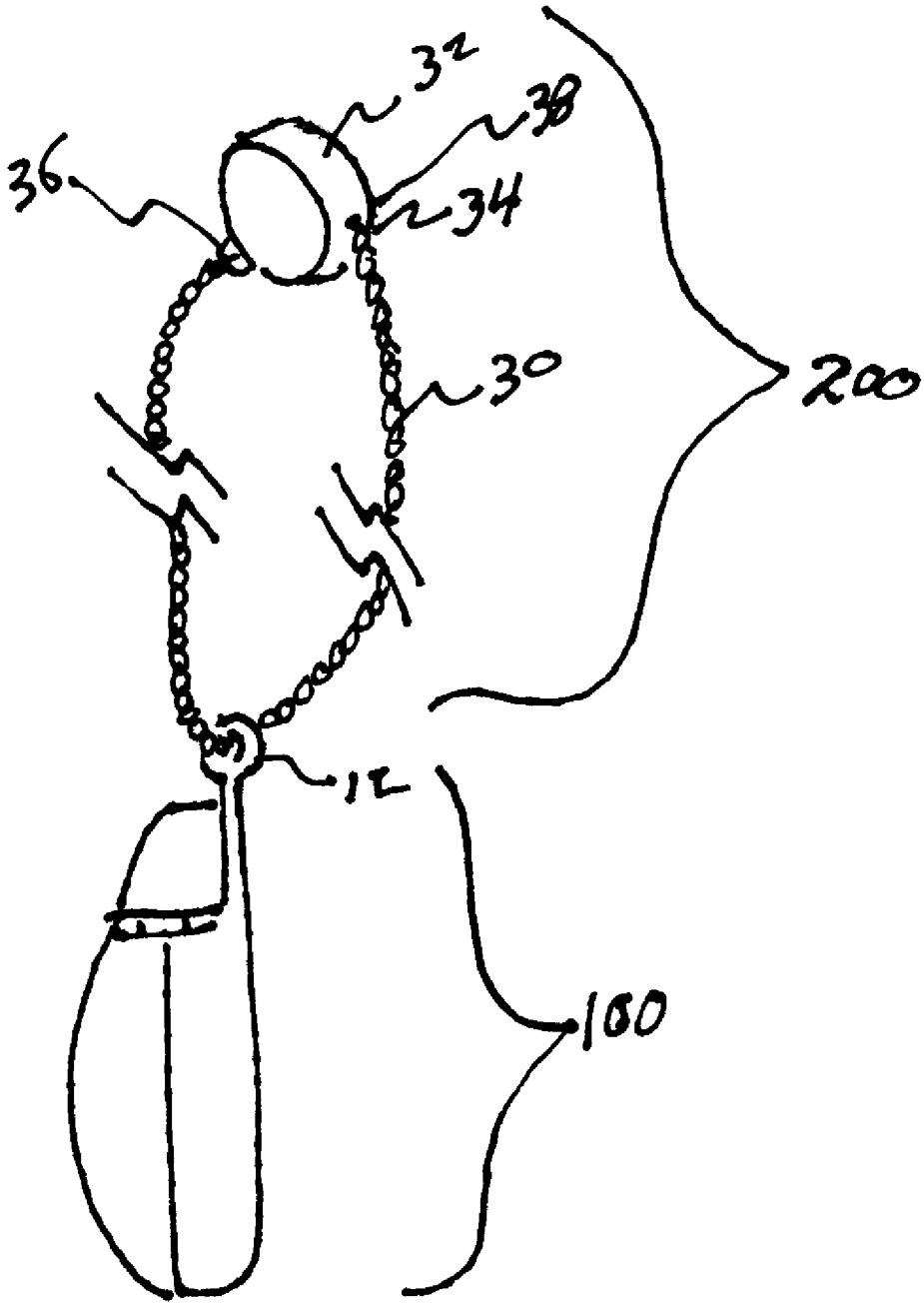
FIG. 6 shows a side view of the pendant and an attached necklace assembly.
Figure 7:
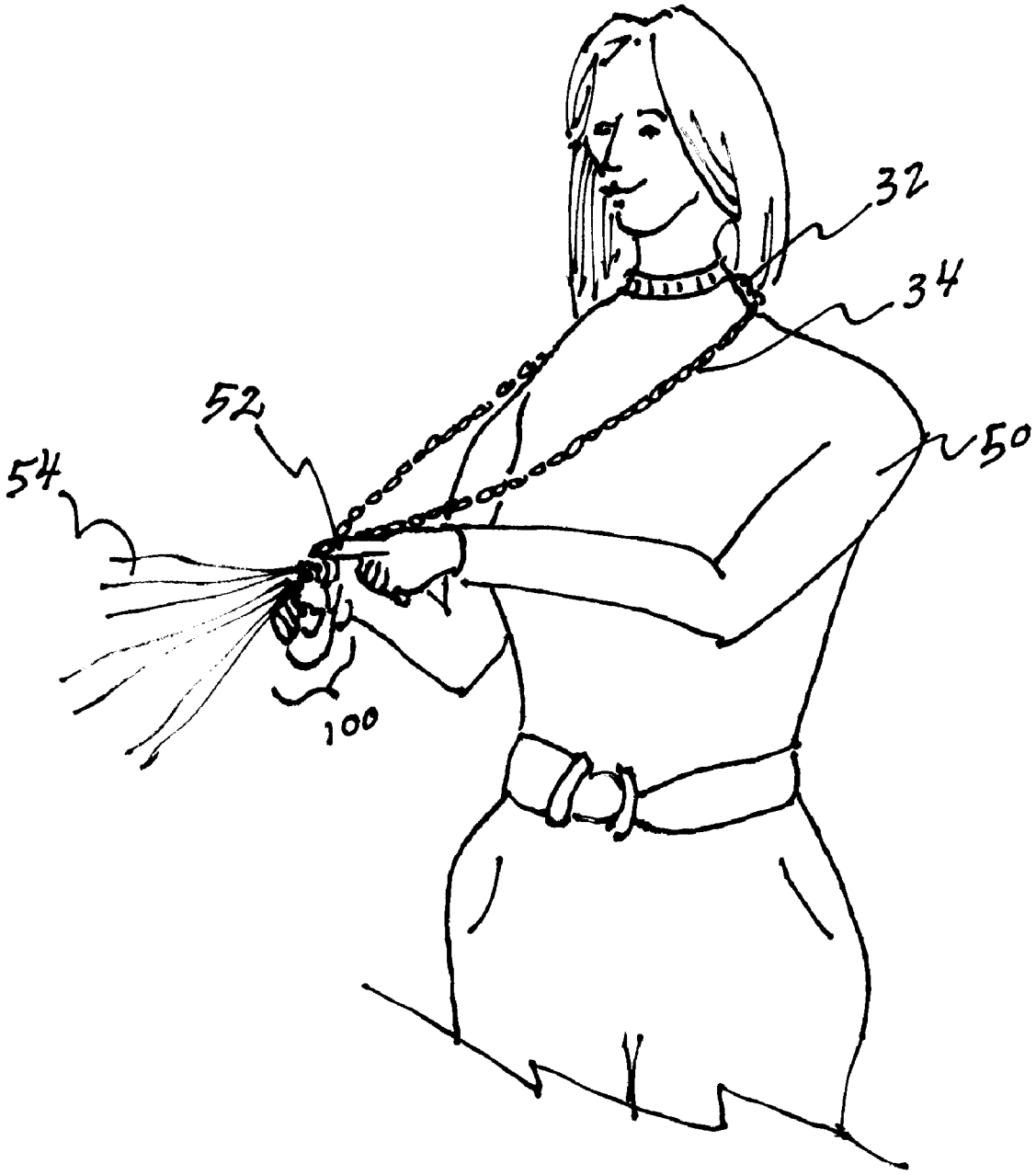
FIG. 7 is a perspective view of a person using the pepper spray device of the present invention.

Referring now to FIG. 1 we see a front view of the main body 2 of the present invention. The main body 2 is made of rigid material such as metal or hard plastic or wood. In this view we see the outline of a recess 4 for retaining a pressurized cannister 6 and associated spray head 8. Cannister 6 holds pepper spray in a pressurized condition. The amount of pepper spray contained within the cannister 6 is enough to product at least ten seconds of spray material to be emitted when the spray head 8 is pushed down by the user. A hinged 18 lid 10 acts to cover and protect the spray head 8 when not in use. Necklace holding portion 12 is located at the top of the main body 2. Apertures 14, 16 allow screws to penetrate threaded apertures in the front cover thereby holding the main body 2 and the front cover 20 together. FIG. 2 shows a side view of the entire pendant assembly 100. In this view it can be seen that the front cover is also hollowed out to allow the cannister 6 to fit inside the assembly 100. FIG. 3 shows a front view of the front cover 20. Decorative element 22 is embedded into the front cover 20. There can be a plurality of front covers, each with a different decorative element. Lid 10 is shown in the closed position. In this position, the spray head can not be accidentally activated. Aperture 60 allows pepper spray to exit the front housing 20. FIG. 4 shows a rear view of the main body 2. Screws 24 and 2 are shown in place, thereby holding the front cover 20 securely to the main body 2. FIG. 5 shows a person 50 wearing the pendant 100 of the present invention. The pendant 100 is designed to look like an ordinary piece of jewelry and therefore not threatening in appearance. FIG. 6 shows a side view of the pendant 100 and an attached necklace assembly 200. The necklace 30 is fastened to the pendant through aperture 12. The necklace 30 is attached at one end to a stationary connection point 36 located on the side wall of standard spring reel assembly 32. The other end of necklace 30 is attached to a lanyard 34 that is capable of sliding out of and returning into aperture 38 located on the opposite side wall of spring reel assembly 32. FIG. 7 shows a person 50 using the pepper spray function of the present invention. The use is accomplished by the user 50 pulling the pendant assembly 100 away from her body and pressing her finger 52 on the spray head 8 thereby releasing pepper spray 54. The spring reel assembly 32 allow the lanyard 34 to extend out from the body of the spring reel assembly thereby allowing the user to position the spray head 8 away from her body to a useful position, without the user needing to remove the necklace from her neck.

In the above described and illustrated way, a person can wear a pendant that looks like a harmless piece of jewelry, and, when necessary, transform the pendant into an effective deterrent to an attacker.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Self defense pendant and necklace comprising:

a pendant assembly comprising a removable and replaceable front panel, a main body capable of retaining a small pressurized spray cannister and associated spray head and a hinged top portion that allows access to the top of said spray head;

said pendant front including a horizontally disposed orifice at its top portion that allows pepper spray to exit the front of said pendant assembly;

said main body including an orifice at its top most portion to allow a necklace to be attached to said pendant assembly;

said pendant front including a decorative element; and a necklace assembly that includes a necklace and attached lanyard, said lanyard retained in a coiled manner inside a standard spring reel assembly so that said necklace can be extended outward when the user wants to access the pepper spray function and automatically return to its original position after use as a defensive implement.

* * * * *